US005564935A

United States Patent [19]

Yagi et al.

[11] Patent Number: 5,564,935

[45] Date of Patent: Oct. 15, 1996

[54] CONNECTOR ENGAGEMENT DEVICE

[75] Inventors: Sakai Yagi; Tamio Watanabe, both of Shizuoka, Japan

[73] Assignee: Yazaki Corporation, Tokyo, Japan

[21] Appl. No.: 506,519

[22] Filed: Jul. 25, 1995

[30] Foreign Application Priority Data

Jul. 25, 1994 [JP] Japan ..... 6-172670

[51] Int. Cl.[6] ..... H01R 13/62

[52] U.S. Cl. ..... 439/157; 439/372

[58] Field of Search ..... 439/152–160, 439/372

[56] References Cited

U.S. PATENT DOCUMENTS

| | | | |
|---|---|---|---|
| 4,152,038 | 5/1979 | Inouye et al. | 439/372 |
| 4,586,771 | 5/1986 | Kraemer et al. | 439/157 |
| 5,244,400 | 9/1993 | Hatagishi | 439/157 |
| 5,320,544 | 6/1994 | Naoto et al. | 439/157 |

FOREIGN PATENT DOCUMENTS

| | | | |
|---|---|---|---|
| 63-99787 | 6/1988 | Japan | H01R 23/00 |
| 4-29179 | 3/1992 | Japan | H01R 13/639 |

*Primary Examiner*—David L. Pirlot
*Assistant Examiner*—Brian Biggi
*Attorney, Agent, or Firm*—Sughrue, Mion, Zinn, Macpeak & Seas

[57] ABSTRACT

A pair of left fulcrum axis pins and a pair of right fulcrum axis pins are provided on a female connector so as to project so that a first operation cam member having operation cam grooves over the pair of left fulcrum axis pins and a second operation cam member having operation cam grooves over the pair of right fulcrum axis pins are pivotally supported on the fulcrum axis pins so as to be rotatable and able to be operated in mutually interlocked state. Left and right engagement pins capable of being engaged with the operation cam grooves respectively are provided in a male connector so as to project. An operation lever is provided on at least one of the operation cam members so as to extend.

5 Claims, 6 Drawing Sheets

CONNECTOR ENGAGEMENT DEVICE

BACKGROUND OF THE INVENTION

The present invention relates to an improvement of a connector engagement device which is mainly adapted for mutual connection of connection terminal sets each having a large number of connection terminals such as car wire harness, so that mutual connection locking of a pair of female and male connectors is performed under a small insertion removal force by leverage of an operation cam lever.

As a general connector engagement device for performing connection under a small insertion removal force by using such an operation cam lever, for example, there is such a configuration as disclosed in Japanese Utility Model Unexamined Publication No. Hei. 4-29179. Hereupon, the outline of the conventional configuration and the state of the engaging operation are shown in FIGS. 9 through 12 successively.

In the configuration shown in each of FIGS. 9 through 12, the conventional connector engagement device for performing connection under a small insertion removal force comprises a pair of female and male connectors 81 and 91, and an operation cam lever 101. The female connector 81 has a housing portion 82 in which a set of connection terminals (not shown) are received so as to face the connection opening end portion side of the housing portion 82 and has a pair of fulcrum axis pins 83 each formed so as to project on a connectionwise center line Sb corresponding to the nearly middle portion of effective overall width w1 on a connection end portion side of each of the opposite sides (only one side is illustrated in the drawings) of the housing portion 82. Similarly to the female connector 81, the male connector 91 has a housing portion 92 in which a set of connection terminals (not shown also in this case) to be connected to the set of connection terminals of the female connector 81 are received so as to face the connection opening end portion side of the housing portion 92 and has a pair of engagement pins 93 each formed so as to project on a connectionwise center line Sb corresponding to the nearly middle portion of effective overall width w2 on a connection end portion side of each of the opposite sides (only one side is illustrated in the drawings also in this case) of the housing portion 92. The operation cam lever 101 is designed so as to be mounted to cover the opposite sides of the female connector 81 and rotatably pivotally supported on the fulcrum axis pins 83, and is provided with a pair of cam grooves 102 formed in its opposite sides so that the male connector 91 can be pulled toward the female connector 81 side under the condition that the two engagement pins 93 of the male connector 91 on its opposite sides are engaged with the two cam grooves 102 of the operation cam lever 101 in its opposite sides, respectively.

Thus, as the operation cam lever 101 is operated to rotate, the connection opening end portion of the male connector 91 is fittingly received or inserted into the connection opening end portion of the female connector 81 so that the sets of connection terminals of the male and female connectors can be mutually connected to each other.

Each of the cam grooves 102 of the operation cam lever 101 is composed of: a lead-in opening portion 102*a* which can receive, without any stress, a corresponding one of the engagement pins 93 of the male connector 91 in the condition that fulcrum axis pins 83 of the female connector 81 are set to be pivotal points of the operation cam lever 101 and the operation cam lever 101 is held in its open position; a guide cam groove portion 102*b* connected to the lead-in opening portion 102*a* and extended so as to gradually approach the pivotal points; and a locking groove portion 102*c* located at a terminal connected to the guide cam groove portion 102*b* for holding the engagement pin 93 of the male connector 91 at a locking position of the operation cam lever 101 in the state that the operation cam lever 101 has been rotated into the locking position.

Accordingly, in the case of the aforementioned conventional connector engagement device, when the set of connection terminals of the male connector 91 are first temporarily connected to the set of connection terminals of the female connector 81 by shallow insertion of the male connector 91 into the female connector 81 in a state (FIG. 9) in which the connection opening end portion of the male connector 91 is put so as to face the connection opening end portion of the female connector 81, the engagement pins 93 of the male connector 91 are led into the lead-in opening portions 102*a* of the operation cam lever 101 which are held in the open position in the state that the cam lever 101 is pivotally supported on the female connector 81 (FIG. 10).

When the operation cam lever 101 on the female connector 81 is then rotated in the engagement direction shown by arrow around the pivot point of the fulcrum axis pins 83 in the aforementioned condition, the engagement pins 93 of the male connector 91 led in the lead-in opening portions 102*a* of the operation cam lever 101 are guided by the guide cam grooves 102*b* which are formed so as to be made closer to the pivot point gradually to the fulcrum axis pins 83. As a result, the engagement pins 93 are pulled to the engagement position gradually by a relatively small rotational-direction operating force because of the leverage around the pivot point of the guide cam groove portions 102*b*, so that the set of connection terminals of the male connector 91 are connected gradually deeply to the set of connection terminals of the female connector 81. When the engagement pins 93 reach the respective terminals of the guide cam groove portions 102*b*, the two sets of connection terminals are connected to each other (FIG. 11).

When the rotating operation of the operation cam lever 101 is further continued, the engagement pins 93 are received respectively in the locking groove portions 102*c* to thereby lock the state of connection of the set of connection terminals of the male connector 91 in the set of connection terminals of the female connector 81. Thus, the complete connection is finished (FIG. 12). In this connection completion state, the engagement pins 93 of the male connector 91 are moved toward the female connector 91 side to a predetermined distance on the connectionwise center line Sb in the direction of connection which passes through the pivot point of the female connector 81 and held there.

Incidentally, the locked connection state can be unlocked easily by an operation reverse to the aforementioned operation.

In the aforementioned conventional connector engagement device, however, the pair of engagement pins 93 projected on the male connector 91 are pulled toward the female connector 81 side by the pair of guide cam groove portions 102*b* formed in the operation cam lever 101 which is mounted on the female connector 81 so as to be pivotally supported so that the overall mutual connection of the set of connection terminals of the male connector 91 to the set of connection terminals of the female connector 81 is performed by a small insertion removal force effected by the leverage. Accordingly, particularly because of the operating force applied in the later stage of the connecting operation, when the state of connection of the set of connection terminals of the male connector 91 into the set of connection terminals of the female connector 81 is seen on the whole, the operation cam lever 101 becomes such that, upon completion of the connecting operation, the connection operating force B of the operation cam lever 101 on the connecting operation terminating end b side is inevitably stronger than the connection operating force A on the connecting operation initiating end a side. As a result, these connection operating forces have the relation A<B.

Accordingly, if the connection operating forces applied at the time of the mutual connection of the two sets of connection terminals of the female and male connectors 81 and 91 are unbalanced between the connecting operation initiating end a side and the connecting operation terminating end b side with respect to the operation cam lever 101, the direction of fittingly connection of the male connector 91 into the female connector 81 is apt to be disposed toward the connecting operation terminating end b side on the predetermined connectionwise center line Sb. Accordingly, there arises a disadvantage in that the smoothness of the connecting operation is impeded. On the other hand, the connecting operation initiating end a side subjected to the connection operating force A weaker than the connection operating force B is apt to be floated up in the direction of non-connection because of the stronger connection operating force B given to the connection terminating end b side. Accordingly, the connecting operation initiating end b side is apt to become unstable, so that it becomes impossible to give required uniform contact pressure between all the connection terminals. Consequently, there arises a problem that lowering of reliability on the mutual connection is brought about.

SUMMARY OF THE INVENTION

The present invention is provided to solve the aforementioned problems in the prior art and an object of the present invention is to provide a connector engagement device by which the direction of fitting connection of a male connector into a female connector is maintained so as to be continuously arranged along a required connectionwise center line so that not only the smoothness of the connecting operation can be attained but also reliability on the mutual connection of the sets of connection terminals of the female and male connectors can be improved.

In order to solve the above problem, according to a first aspect of the present invention, the connector engagement device is provided with a first connector, that is, one of male and female connectors, and a second connector, that is, the other one of the male and female connectors, for mutually connecting a set of connection terminals included in the first connector and a set of connection terminals included in the second connectors, wherein a pair of left and right fulcrum axis pins are formed so as to project respectively on each of opposite sides of the first connector, and a pair of first and second cam members each of which has an operation cam groove of a required shape are provided on each of the opposite sides of the first connector so as to mount on and rotatably engage with the pair of fulcrum axis pins respectively and so as to be able to operate in interlock with each other; wherein engagement pins are formed to project on each of opposite sides of the second connector so as to correspond to the fulcrum axis pins respectively and so as to be engageable with the operation cam grooves respectively, and wherein an operation cam lever is provided on at least one of the first and second operation cam members so as to be extended therefrom so that the engagement pins can be pulled toward the first connector side through the operation cam grooves by the turning operation of the operation lever.

In order to solve the above problem, according to a second aspect of the present invention, the connector engagement device is provided with a first connector, that is, one of male and female connectors, and a second connector, that is, the other one of the male and female connectors, for mutually connecting a set of connection terminals included in the first connector and a set of connection terminals included in the second connectors, wherein a plurality of fulcrum axis pins are formed along a left-right direction so as to project on each of opposite sides of the first connector, and a pair of first and second cam members each of which has an operation cam groove of a required shape are provided so as to mount on and rotatably engage with at least two, left and right ones of the fulcrum axis pins and so as to be able to operate in interlock with each other through an interlocking member which rotatably engage with an intermediate one of the fulcrum axis pins, wherein engagement pins are formed to project on each of opposite sides of the second connector so as to correspond to the left and right end fulcrum axis pins respectively and so as to be engageable with the operation cam grooves respectively, and wherein an operation cam lever is provided so as to be integrally with or so as to be extended from at least one of the interlocking member and the first and second operation cam members so as to be extended therefrom so that the engagement pins can be pulled toward the first connector side through the operation cam grooves by the turning operation of the operation lever.

Because first and second operation cam members having operation cam grooves of required shapes respectively and provided so as to be able to be operated mutually in interlock are provided on a first connector, and engagement pins capable of being engaged with the operation cam grooves respectively are provided on a second connector so as to project, the engagement pins are pulled through the operation cam grooves respectively by the turning operation of an operation lever extended on the first operation cam member or the second operation cam member. In this occasion, the second connector is moved parallel or substantially parallel with the first connector. As a result, both the smoothness in the connecting operation and the improvement of reliability on the mutual connection between sets of connection terminals of the female and male connectors can be attained.

On the other hand, because a plurality of operation cam members capable of attracting a plurality of engagement pins provided on a second connector are provided on a first connector so that the plurality of operation cam members can be operated in interlock with each other through an interlocking member, the mutual connection of the first and second connectors can be effected under a low insertion removal force without increase of the size of the operation cam members, or the like, for example, even in the case where connector size increases. Further, for example, even in the case where the angle for turning the operation lever is small, a large quantity of pulling-in of the engagement pins can be obtained as long as suitable engagement ratios among the operation cam members and the interlocking member are selected.

DETAILED DESCRIPTION OF THE INVENTION

Preferred embodiments of the connector engagement device according to the present invention will be described below in detail with reference to the drawings.

Figure 1:
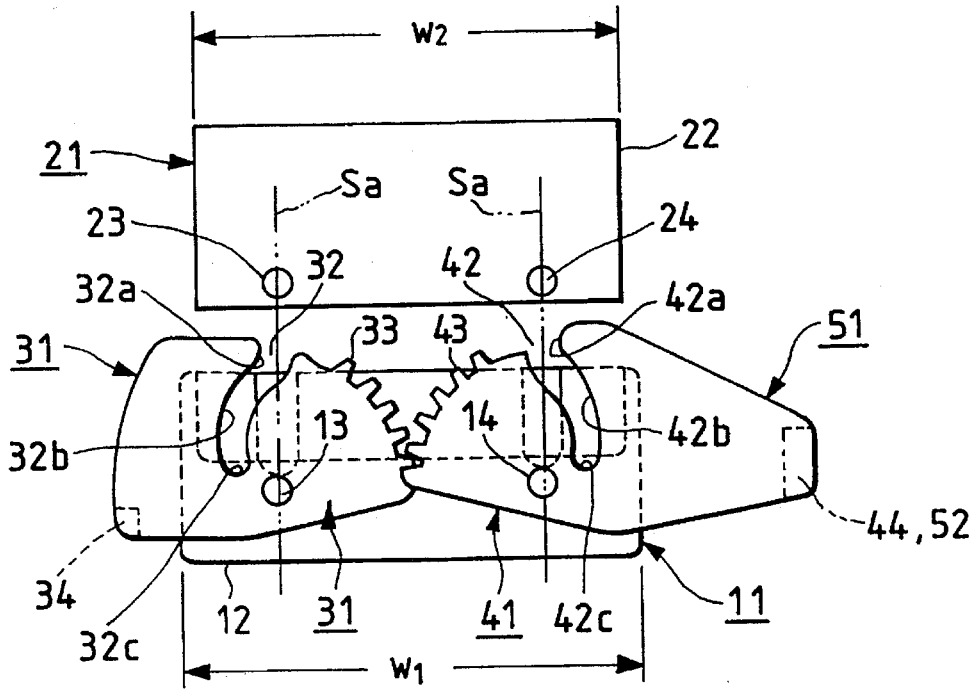
FIG. 1 is a front explanatory view typically showing a schematic configuration of female and male connectors to which a first embodiment of a connector engagement device according to the present invention is applied.
Figure 2:
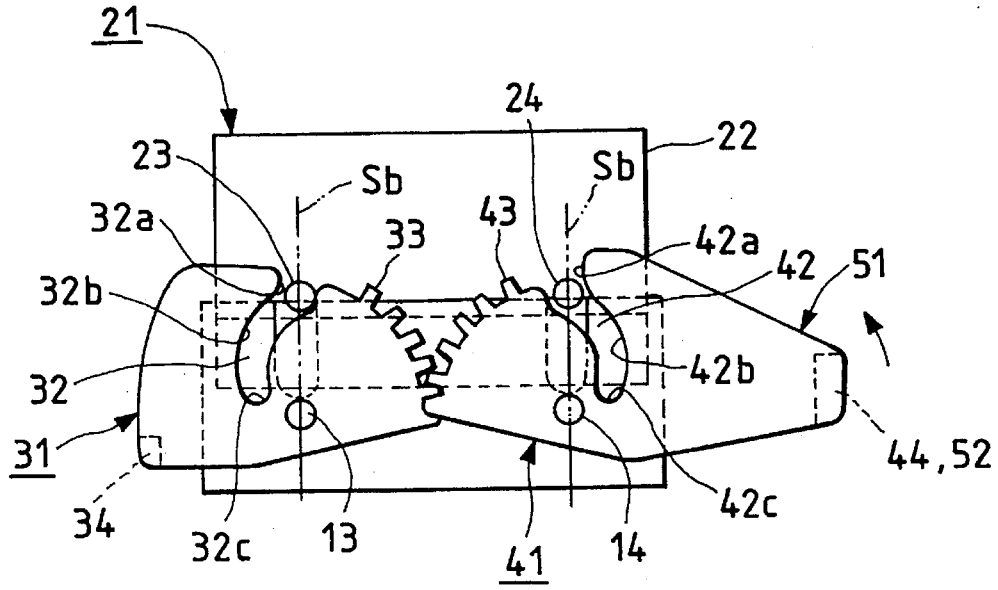
FIG. 2 is a front explanatory view typically showing the outline of a connection preparation state for the female and male connectors in the first embodiment of FIG. 1.
Figure 3:
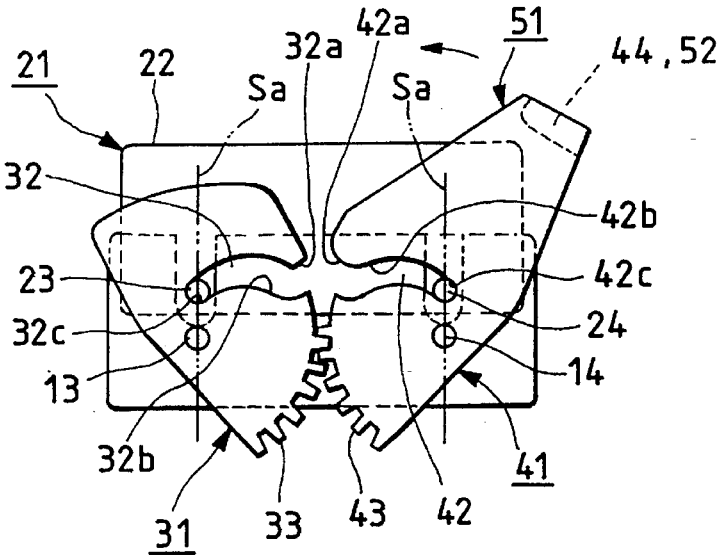
FIG. 3 is a front explanatory view typically showing the outline of a connection completion state for the female and male connectors in the first embodiment of FIG. 1.
Figure 4:
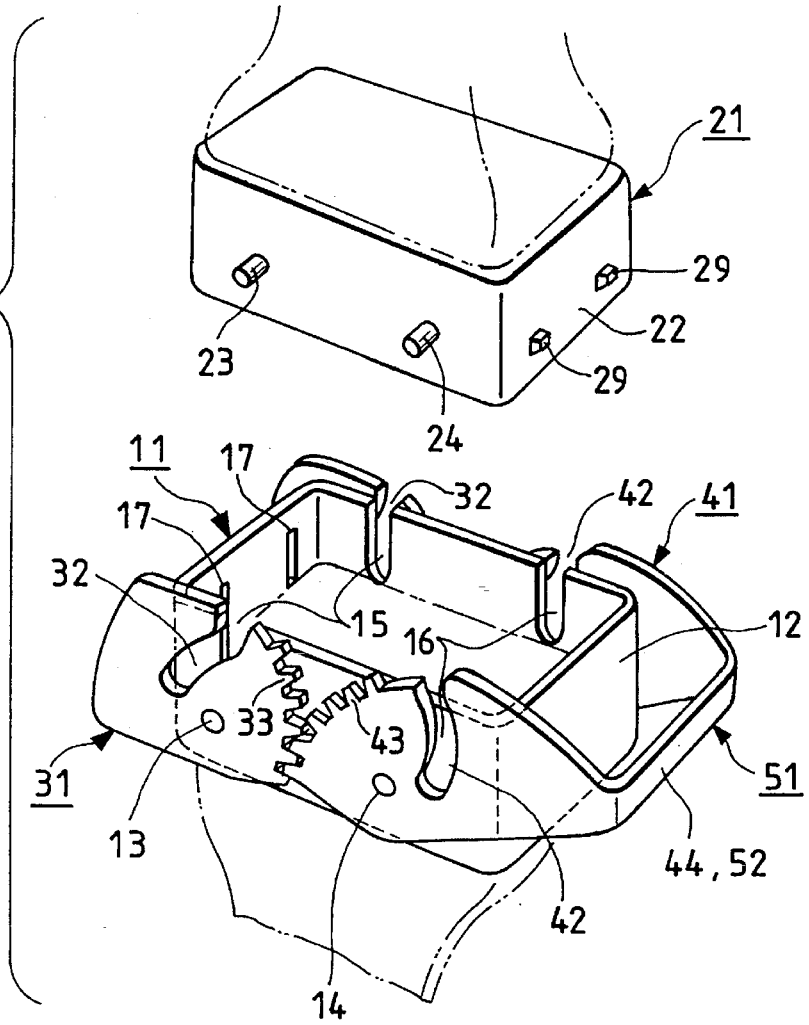
FIG. 4 is a perspective view showing a configuration of important part of the female and male connectors in the first embodiment of FIG. 1.

FIG. 1 through 3 are front explanatory views typically successively showing the outline of the state of connecting operation of connectors to which the engagement device according to a first embodiment of the present invention is applied, and FIG. 4 is a perspective view showing only the configuration of important part of the female and male connectors taken out from the embodiment of FIGS. 1 through 3. In these drawings, part of detailed structure is omitted suitably as occasion demands to facilitate the understanding of the gist of the present invention.

In the configurations shown in FIGS. 1 through 3 and FIG. 4, the connector engagement device of this first embodiment comprises a first connector constituted by one of female and male connectors, that is, a female connector 11 in this example, and a second connector constituted by the other one of the female and male connectors, that is, a male connector 21 in this example.

In the female connector 11, a set of connection terminals (not shown) are received in a housing portion 12 so as to face the connection opening end portion side of the housing portion 12 and a pair of left fulcrum axis pins 13 and a pair of right fulcrum pins 14 are provided so as to project on connectionwise center lines Sa, Sa corresponding to left and right uniform positions in effective overall width w1 on the opposite sides (only one side is illustrated in the drawings) of the housing portion 12 at its connection end portion side. Further, in the female connector 11, as shown in FIG. 4, a pair of left notch grooves 15 and a pair of right notch grooves 16 capable of receiving engagement pins which will be described later are formed in suitable positions near the fulcrum axis pins 13 and 14 on opposite side walls of the female connector 11. Further, in the female connector 11, as shown in FIG. 4, a pair of temporary locking grooves (only one side is illustrated in FIG. 4) 17 extended in the direction of the axial line are formed in the inner surface of each of opposite side walls different from the aforementioned side walls in which the notch grooves 15 and 16 are formed.

Similarly to this, in the male connector 21, a set of connection terminals (not shown also in this case) which are to be connected to the set of connection terminals of the female connector 11 are received in a housing portion 22 so as to face the connection opening end portion side of the housing portion 22 and a pair of left engagement pins 23 and a pair of right engagement pins 24 are provided so as to project respectively on the connectionwise center lines Sa, Sa corresponding to left and right uniform positions in effective overall width w2 on the opposite sides (only one side is illustrated in the drawings also in this case) of the housing portion 22 at its connection end portion side. Further, in the male connection 21, temporary locking projections 29 capable of being fitted into the temporary locking grooves 17 of the female connector 11, respectively, are provided so as to project on outer surfaces (only one side is illustrated in FIG. 4 also in this case) of opposite side walls different from the aforementioned side walls on which the engagement pins 23 and 24 are provided.

A first operation cam member 31 having a pair of operation cam grooves 32 over the pair of left fulcrum axis pins 13 of the female connector 11 to pull the pair of left engagement pins 23 toward the female connector 11 side and having its front and rear sides connected by a bridge-like link portion 34 is pivotally supported on the pair of left fulcrum axis pins 13 so as to be rotatable. A second operation cam member 41 having a pair of cam grooves 42 over the pair of right fulcrum axis pins 14 of the female connector 11 to pull the pair of right engagement pins 24 toward the female connector 11 side and having its front and rear sides connected by a bridge-like link portion 44 is pivotally supported on the pair of right fulcrum axis pins 14 so as to be rotatable.

In the first and second operation cam members 31 and 41, the left and right pairs of operation cam grooves 32 and 42 are formed in symmetric positions and in symmetric directions. The first and second operation cam members 31 and 41 have sector gears each formed in a required angular range around each of the fulcrum axis pins 13 and 14. That is, the first and second operation cam members 31 and 41 have teeth 33 and 43 so that the operation cam members 31 and 41 can be operated interlock with each other in directions different from each other by the engagement of the teeth 33 and 43. Further, an operation lever 51 is extended from at least one of the operation cam members 31 and 41, for example, from the second operation cam member 41 in this embodiment, and a hold portion 52 for turning the operation lever 51 is formed in an extension end portion (equivalent to the aforementioned link portion 44 in this case) of the operation lever 51.

On the other hand, each left operation cam groove 32 and each right operation cam groove 42 have a left lead-in opening portion **32*a* and a right lead-in opening portion 42*a*, a left guide cam groove portion 32***b* and a right guide cam groove portion 42*b*, and a left locking groove portion 32*c* and a right locking groove portion 42*c*, respectively. In a state that the pivotal points where the operation cam members 31 and 41 are respectively pivotally mounted on the fulcrum axis pins 13 and 14 of the female connector 11 are set as the center of rotation so that the operation lever 51 is held in an open position, the left and right lead-in opening portions 32*a* and 42*a* can receive easily and not-forcibly the left and right engagement pins 23 and 24 of the male connector 21, respectively. The left and right guide cam groove portions 32*b* and 42*b* are formed so as to be continuously connected to the left and right lead-in opening portions 32*a* and 42*a* respectively and so as to extend to gradually approach the above-mentioned pivotal points respectively and have cam groove surfaces for pulling the engagement pins 23 and 24 into the operation cam grooves 32 and 42 deeply (at the time of connection) and pushing the engagement pins 23 and 24 away from the operation cam grooves 32 and 42 (at the time of opening). The left and right locking groove portions 32*c* and 42*c* are formed so as to be continuously connected to the left and right guide cam groove portions 32*b* and 42*b* respectively and so as to be terminated so that the left and right locking groove portions 32*c* and 42*c* hold the left and right engagement pins 23 and 24 respectively at their locked positions in a state where the operation cam lever 51 has been rotated to its locked position.

Hereupon, for reinforcement against the operation cam grooves 32 and 42, bridge-like reinforcement portions are preferably formed so as to avoid the respective opening end portion sides.

Accordingly, in the case of the first embodiment, the left and right operation cam grooves 32 and 42 can move the left and right engagement pins 23 and 24 respectively so that the left and right engagement pins 23 and 24 are pulled in the direction of connection along the connectionwise center lines Sa, Sa or pushed away in the direction of opening along the connectionwise center lines Sa, Sa by the cam operation of the operation cam grooves 32 and 42 because of the rotation of the first and second operation cam members 31 and 41 attended on the turning operation of the operation cam lever 51. In other words, the operation cam grooves 32 and 42 make it possible to move the male connector 21 in parallel with the female connector 11 to thereby fittingly connect the male connector 21 into the female connector 11, that is, the operation cam grooves 32 and 42 make it possible to mutually connect the sets of connection terminals of the male and female connectors 11 and 21 to each other or disconnect the sets of connection terminals from each other.

That is, more in detail, in the connector engagement device of the first embodiment configured as described above, when the set of connection terminals of the male connector 21 are first temporarily connected respectively correspondingly to the set of connection terminals of the female connector 11 by shallow insertion of the male connector 21 into the female connector 11 in a state (FIG. 1) in which the connection opening end portion of the male connector 21 is put so as to face the connection opening end portion of the female connector 11, not only the temporary locking projections 29 are fitted into the temporary locking grooves 17 of the female connector 11 to thereby temporarily hold the male connector 21 but also the left and right engagement pins 23 and 24 of the male connector 21 are led respectively into the lead-in opening portions 32*a* and 42*a* of the left and right operation cam grooves 32 and 42 of the operation cam members 31 and 41 which are held in their open positions in a state where the operation cam members 31 and 41 are pivotally supported on the fulcrum axis pins 13 and 14 of the female connector 11 (FIG. 2).

Next, in such a state as mentioned above, when an end hold portion 52 of the operation cam lever 51 located on the female connector 11 side is rotated around the pivotal points of the fulcrum axis pins 14 in the direction of engagement indicated by an arrow, the operation cam members 31 and 41 are rotated in interlock with each other in directions different from each other so that the left and right engagement pins 23 and 24 of the male connector 21 respectively led into the left and right lead-in opening portions 32*a* and 42*a* are guided by the guide cam groove portions 32*b* and 42*b* which are formed so as to gradually approach the pivotal points. Accordingly, the male connector 21 is moved to be gradually pulled to the position of engagement with the female connector 11 under a relatively small rotationally operating force by the leverage of the guide cam groove portions 32*b* and 42*b* around the pivotal points while the male connector 21 is held parallel or substantially parallel to the female connector 11.

Thus, the set of connection terminals of the male connector 21 are connected gradually deeply to the corresponding set of connection terminals of the female connector 11. When the engagement pins 23 and 24 reach the terminating ends of the guide cam groove portions 32*b* and 42*b* respectively, the two sets of connection terminals of the female and male connectors 21 and 11 are connected to each other. Thereafter, if the operation cam lever 51 is operated to rotate, the engagement pins 23 and 24 are received into the locking groove portions 32*c* and 42*c* respectively to thereby effect the perfect connection and locking between the set of connection terminals of the male connector 21 and the set of connection terminals of the female connector 11, thus completing the required connecting operation (FIG. 3).

Here, if the above operation is effected reversely, the connection state can be easily released.

In such a configuration of the first embodiment, accordingly, as the operation cam lever 51 is operated to rotate, the left and right engagement pins 23 and 24 of the male connector 21 are pulled toward the female connector 11 side by the cam action of the left and right cam grooves 32 and 42, particularly by the left and right guide cam groove portions 32*b* and 42*b*, while the male and female connectors 11 and 21 are kept parallel along the connectionwise center lines Sa, Sa. Accordingly, the connection of the set of connection terminals of the male connector 21 to the set of connection terminals of the female connector 11 can be effected extremely easily under uniform or substantially uniform connection pressure.

Further, in such a configuration that the left and right engagement pins 23 and 24 are operated simultaneously and individually by the operation cam grooves 32 and 42 to be locked in their connection positions, since the groove shapes of the guide cam groove portions 32*b* and 42*b* are designed so that the engagement pins 23 and 24 of the male connector 21 can be attracted down uniformly or substantially uniformly, the male connector 21 can be moved parallel or substantially parallel to the female connector 11 so that the operation of mutually connecting the sets of connection terminals of the male and female connectors 21 and 11 can be effected smoothly.

Further, since the connecting forces acting on the left and right sides are balanced or substantially balanced, unlike in the conventional example, the floating-up of one of the left and right sides of the connectors relative to the other as described preliminarily in the prior art can be avoided so that a good and effective connecting condition can be maintained continuously.

Figure 5:
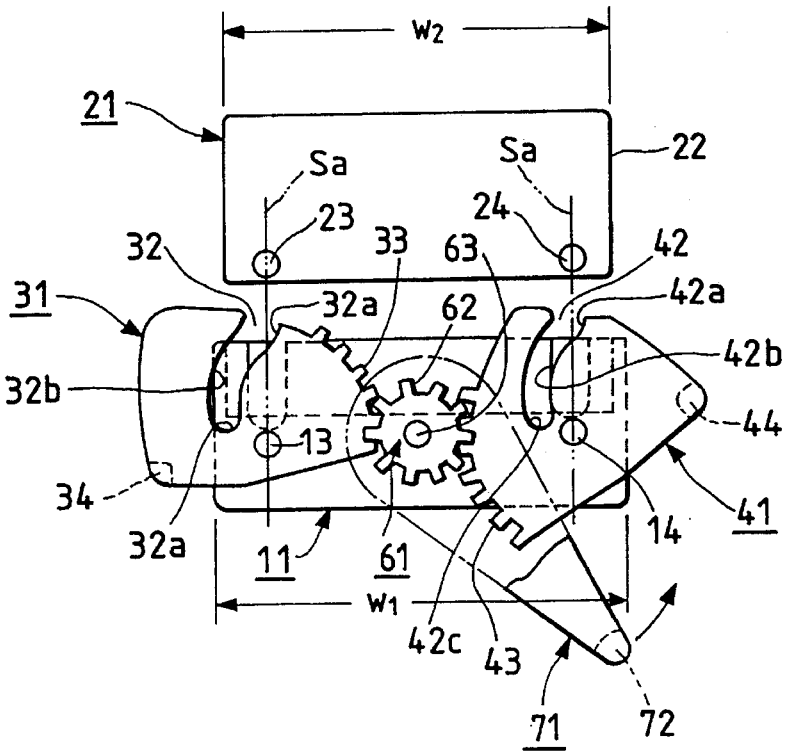
FIG. 5 is a front explanatory view typically showing a schematic configuration of female and male connectors to which a second embodiment of the connector engagement device according to the present invention is applied.
Figure 6:
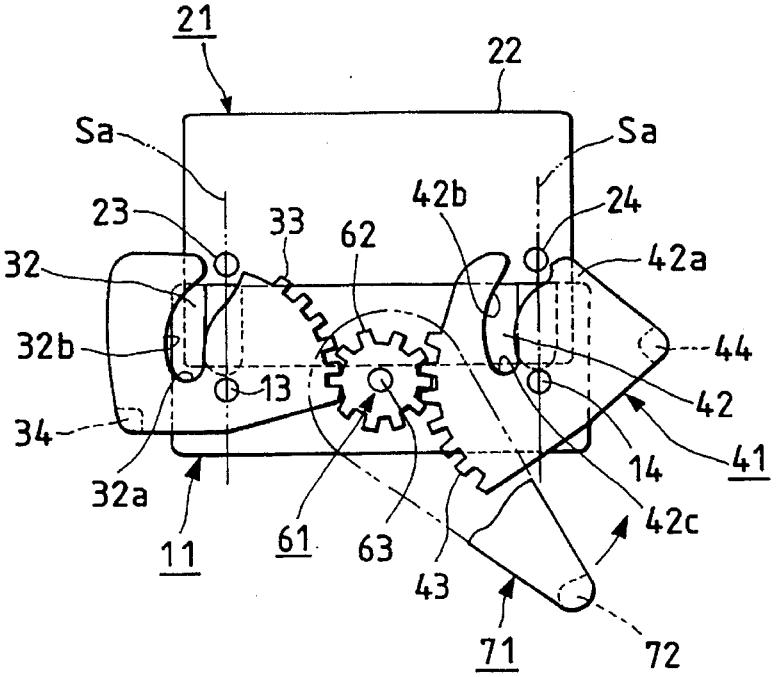
FIG. 6 is a front explanatory view typically showing the outline of a connection preparation state for the female and male connectors in the second embodiment of FIG. 5.
Figure 7:
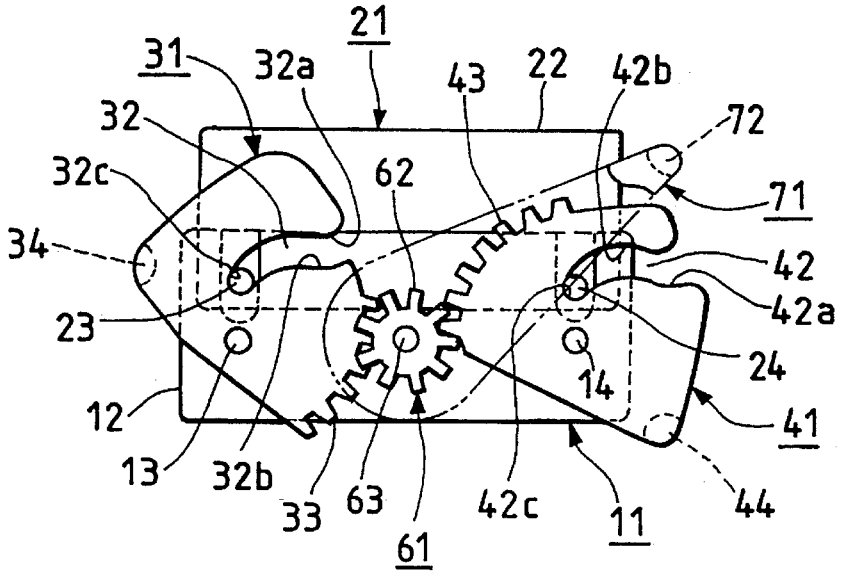
FIG. 7 is a front explanatory view typically showing the outline of a connection completion state for the female and male connectors in the second embodiment of FIG. 5.
Figure 8:
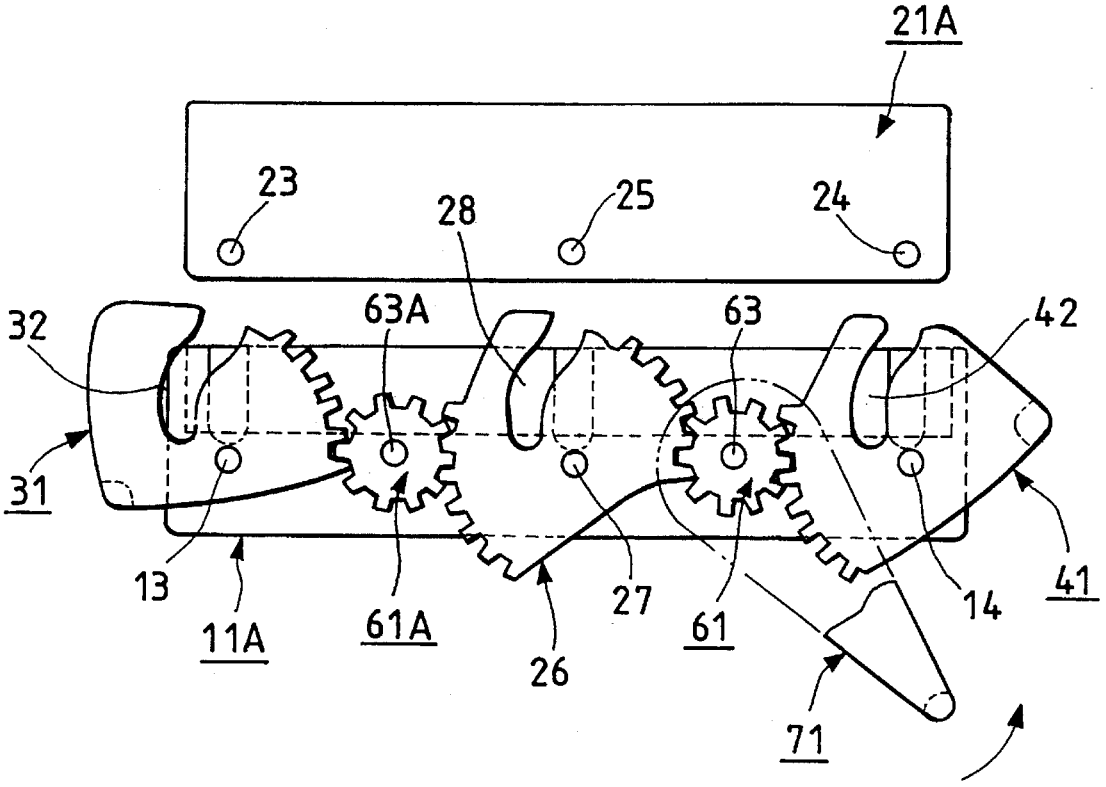
FIG. 8 is a front explanatory view typically showing a schematic configuration of female and male connectors in a modified example of the second embodiment of FIG. 5.
Figure 9:
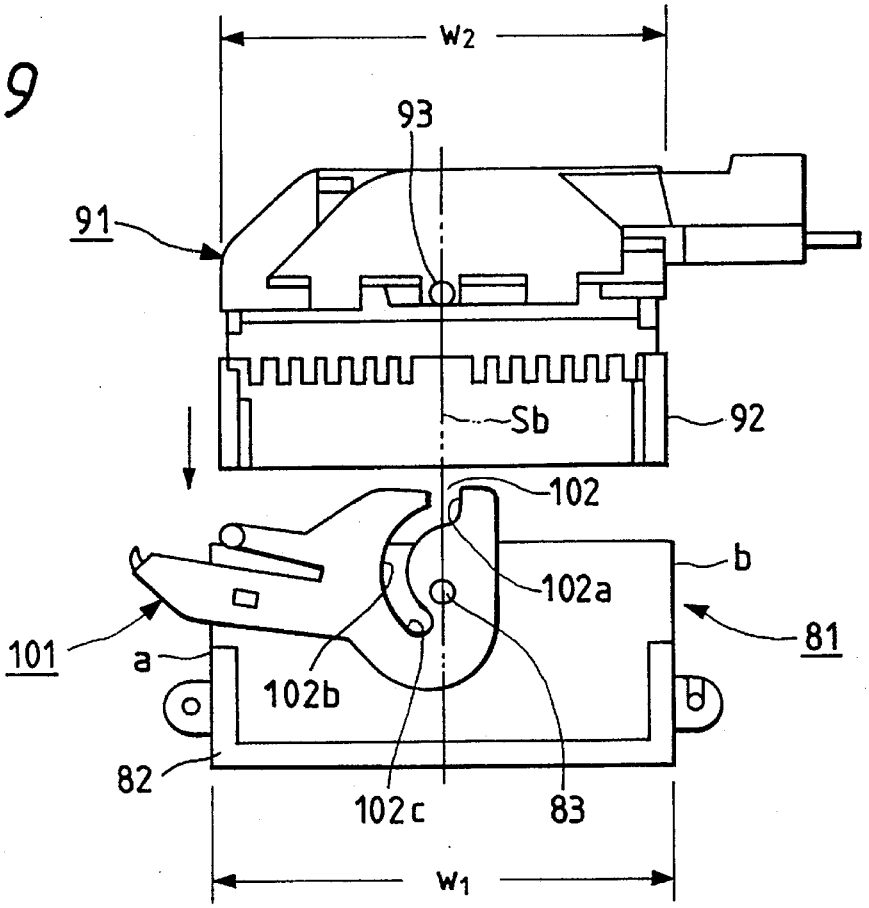
FIG. 9 is a front explanatory view typically showing a schematic configuration of conventional connectors.
Figure 10:
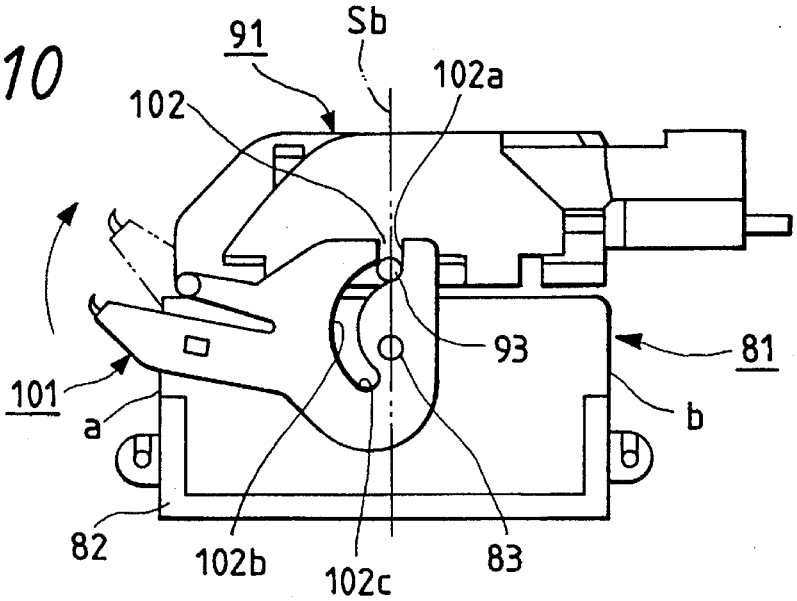
FIG. 10 is a front explanatory view typically showing a connection preparation state of the conventional connectors of FIG. 9.
Figure 11:
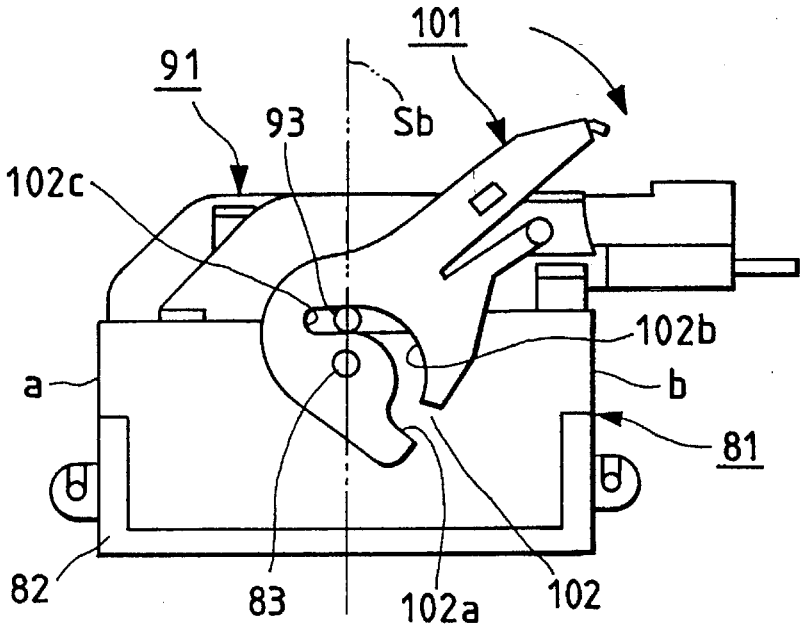
FIG. 11 is a front explanatory view typically showing a connection state of the conventional connectors of FIG. 9.
Figure 12:
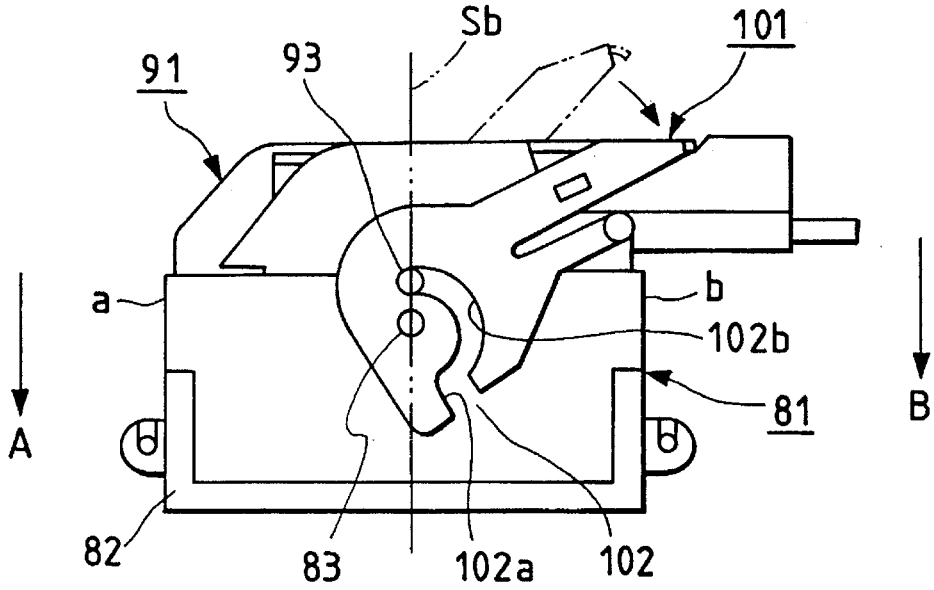
FIG. 12 is a front explanatory view typically showing a connection completion state of the conventional connectors of FIG. 9.

FIGS. 5 through 7 are front explanatory views typically successively showing the outline of the state of the connecting operation of the connectors to which the engagement device according to a second embodiment of the present invention is applied, and FIG. 8 is a front explanatory view showing the connectors in the case where the second embodiment is modified.

In a configuration shown in FIGS. 5 through 7, the connector engagement device according to the second embodiment of the present invention is designed so that an intermediate pair of fulcrum pins 63 are provided respectively between the left and right pairs of fulcrum pins 13 and 14, which are similar to those shown in the above first embodiment, of the female connector 11 so as to project and that interlocking members 61 having teeth 62 on their outer circumferential surfaces respectively are pivotally supported on the fulcrum pins 63 respectively.

The teeth 62 of the interlocking members 61 are engaged with the respective teeth 33 and 43 of the first and second operation cam members 31 and 41 so that the operation cam members 31 and 41 can be operated in interlock with each other. Further, an operation lever 71 having an end portion as a hold portion 72 for the connecting operation is provided so as to be united with the interlocking members 61.

In the case of this embodiment, the first operation cam member 31 as to the shape and form thereof is formed in the same manner as in the case of the first embodiment described previously. On the other hand, the second operation cam member 41 is formed so that the place corresponding to the operation lever 51 (see FIG. 1) is omitted and that the direction of rotation of the second operation cam member 41 becomes equal to the direction of rotation of the first operation cam member 31 because of the interposition of the interlocking member 61 when the interlocking member 61 is operated to rotate. That is, the second operation cam member 41 is formed so that the direction of formation of each operation cam groove 42 is reversed to the case of the first embodiment.

Incidentally, in the connector engagement device of this embodiment, the configuration of parts and positions except the aforementioned configuration is the same as in the previous first embodiment.

Accordingly, also in the case of the second embodiment, the first and second operation cam members 31 and 41 are rotated in the same direction through the interlocking member 61 by the rotation of the end hold portion 72 of the operation lever 71 around the pivotal points of the fulcrum axis pins 63 toward the direction of engagement shown in an arrow, so that the engagement pins 23 and 24 of the male connector 21 are pulled into the operation cam grooves 32 and 42 respectively. As a result, the nearly same operation and effect as in the case of the previous first embodiment can be obtained. Incidentally, in the case of the aforementioned configuration, for example, if the effective diameter of the teeth 62 of the interlocking member 61 interposed between the operation cam members 31 and 41 is set to be smaller than the respective effective diameters of the teeth 33 and 43 of the operation cam members 31 and 41, the connection can be effected under a smaller operating force.

The modified example of the second embodiment shown in FIG. 8 is, for example, adapted to female and male connectors 11A and 21A each having a large number of connection terminals to be received therein and having a large side width of the connectors, that is, a large lateral width, so that the present invention can be achieved without increase of the size of constituent parts or positions. That is, this modified example is configured so that an engagement pin 25 projected on the male connector 21A, an interlocking member 61A pivotally supported on the female connector 11A and a third operation cam member 26 are added to the configuration of the previous second embodiment. More in detail, the third engagement pin 25 is projected on each of the front and rear sides of the male connector 21A so as to be arranged between the left and right engagement pins 23 and 24, so that the third cam member 26 having an operation cam groove 28 provided to engage with the engagement pin 25 is pivotally mounted on the fulcrum axis pin 27 between the first and second operation cam members on the left and right sides so as to be rotatably provided on the female connector 11A. Further, the interlocking member 61A is rotatably provided between the first and third operation cam members 31 and 26 so as to be pivotally supported on the fulcrum axis pin 63A to thereby make it possible to operate the first and third operation cam members 31 and 26 in interlock with each other.

In the aforementioned modified example, a good connection can be effected, for example, even in the connection of large-sized connectors. Incidentally, in the aforementioned modified example, it is a matter of course that the third operation cam member can be replaced by a plurality of interlocking members. As the number of engagement pins to be engaged with the operation cam members increases, the connection of the connectors becomes more stable.

Although the aforementioned configurations of the first and second embodiments have shown the case where the first and second operation cam members are provided on the female connector side and the left and right engagement pins are formed on the male connector side, it is a matter of course that this relation is relative and that the present invention is not always limited to the aforementioned embodiments. For example, the same operation and effect can be obtained even in the case where the locations of these parts are reversed.

Although the configurations of the first and second embodiments have been described upon the case where the respective teeth of the first and second operation cam members are engaged with each other as means for interlocking the first and second operation cam members, other interlocking means such as interlocking means using linkage may be used.

Although the configuration of the first embodiment has shown the case where an operation lever is extended from the second operation cam member, an operation lever may be extended from the first operation cam member or operation levers may be extended from the first and second operation cam members respectively. Although the configuration of the second embodiment has shown the case where an operation lever is combined with the interlocking member, an operation lever may be combined with any one of the operation cam members.

As described in detail above, according to the present invention, a plurality of operation cam members having operation cam grooves are arranged on the first connector along the lateral direction and provided so as to be operated in mutually interlocked state; a plurality of engagement pins to be engaged with the operation cam grooves are provided on the second connector so as to project; and an operation lever is extended from one of the operation cam members. Accordingly, as the operation cam lever is operated to rotate, the engagement pins are pulled toward the first connector side uniformly or substantially uniformly by the cam actions of the operation cam grooves respectively while the first and second connectors are kept parallel with each other along the connectionwise center line. Accordingly, the mutual connection between the first and second connectors can be effected smoothly and easily with a small insertion removal force and the connection of the sets of connection terminals can be effected with connection pressure balanced or substantially balanced as a whole.

What is claimed is:

1. A connector engagement device provided with a first connector of one of male and female connectors, and a second connector of the other one of said male and female connectors, for mutually connecting a set of connection terminals included in said first connector and a set of connection terminals included in said second connectors, said connector engagement device comprising:

a pair of first fulcrum axis pins formed so as to project respectively on each of opposite sides of said first connector;

a pair of second fulcrum axis pins formed so as to project respectively on each of said opposite sides of said first connector;

a pair of first operation cam members each having a first operation cam groove, said pair of first operation cam members being provided on each of said opposite sides of said first connector so as to mount on and rotatably engage with said pair of first fulcrum axis pins;

a pair of second operation cam members each having a second operation cam groove, said pair of second operation cam members being provided on each of said opposite sides of said first connector so as to mount on and rotatably engage with said pair of second fulcrum axis pins, said first and second operation cam members being able to operate in interlock with each other;

a pair of first engagement pins formed to project on each of opposite sides of said second connector so as to correspond to said pair of first fulcrum axis pins and so as to be engageable with said first operation cam grooves;

a pair of second engagement pins formed to project on each of said opposite sides of said second connector so as to correspond to said pair of second fulcrum axis pins and so as to be engageable with said second operation cam grooves; and an operation cam lever provided on at least one of said first and second operation cam members so as to be extended therefrom, said first and second engagement pins being able to be pulled toward said first connector through said first and second operation cam grooves by turning operation of said operation lever.

2. A connector engagement device according to claim 1, wherein each of said first and second operation cam members has teeth formed around corresponding one of said first and second fulcrum axis pins so that said teeth of said first operation cam members are engaged with said teeth of said second operation cam members.

3. A connector engagement device provided with a first connector of one of male and female connectors, and a second connector of the other one of said male and female connectors, for mutually connecting a set of connection terminals included in said first connector and a set of connection terminals included in said second connectors, said connector engagement device comprising:

a pair of first fulcrum axis pins formed so as to project on each of opposite sides of said first connector;

a pair of second fulcrum axis pins formed so as to project on each of said opposite sides of said first connector;

a pair of third fulcrum axis pins formed between said pair of first and second fulcrum axis pins so as to project on each of said opposite sides of said first connector;

a pair of first operation cam members each having a first operation cam groove and provided so as to mount on and rotatably engage with said pair of first fulcrum axis pins;

a pair of second operation cam members each having a second operation cam groove and provided so as to mount on and rotatably engage with said pair of second fulcrum axis pins;

a pair of first interlocking members which rotatably engage with said pair of third fulcrum axis pins, said pair of first and second operation cam members being connected in interlock with each other through said pair of first interlocking members;

a pair of first engagement pins formed to project on each of opposite sides of said second connector so as to correspond to said pair of first fulcrum axis pins and so as to be engageable with said first operation cam grooves;

a pair of second engagement pins formed to project on each of said opposite sides of said second connector so as to correspond to said pair of second fulcrum axis pins and so as to be engageable with said second operation cam grooves; and an operation cam lever provided so as to be integrally with or so as to be extended from at least one of said interlocking member, said first operation cam member and said second operation cam member, said first and second engagement pins being able to be pulled toward said first connector through said first and second operation cam grooves by turning operation of said operation lever.

4. A connector engagement device according to claim 3, wherein each of said first and second operation cam members has teeth formed around corresponding one of said first and second fulcrum axis pins, and said first interlocking member has teeth on its outer circumferential surface so that said teeth of said respective first and second operation cam members and said teeth of said interlocking member are engaged with each other.

5. A connector engagement device according to claim 3, further comprising:

a pair of fourth fulcrum axis pins formed between said first and second fulcrum axis pins so as to project on said opposite sides of said first connector;

a pair of fifth fulcrum axis pins formed between said first and second fulcrum axis pins so as to project on said opposite sides of said first connector;

a pair of third operation cam members each having a third operation cam groove and provided so as to mount on and rotatably engage with said fourth fulcrum axis pins;

a pair of second interlocking member which rotatably engage with said pair of fifth fulcrum axis pins, said first, second and third operation cam members being connected in interlock with each other through said first and second interlocking members; and a pair of third engagement pins formed to project on said opposite sides of said second connector so as to correspond to said fourth fulcrum axis pins and so as to be engageable with said third operation cam grooves.

* * * * *

Adverse Decisions In Interference

Patent No. 5,564,935, Sakai Yagi, Tamio Watanabe, CONNECTOR ENGAGEMENT DEVICE, Interference No. 103,965, final judgment adverse to the patentees rendered January 9, 1998, as to claims 1-5.

*(Official Gazette June 2, 1998)*